US006784773B2

(12) United States Patent
Tsutsui et al.

(10) Patent No.: US 6,784,773 B2
(45) Date of Patent: Aug. 31, 2004

(54) ELECTROMAGNETIC RELAY

(75) Inventors: Kazuhiro Tsutsui, Nagano (JP); Hideyuki Wachi, Iida (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/722,582

(22) Filed: Nov. 21, 2003

(65) Prior Publication Data

US 2004/0130418 A1 Jul. 8, 2004

(30) Foreign Application Priority Data

Nov. 22, 2002 (JP) ..... 2002/338994

(51) Int. Cl.[7] ..... H01F 51/22
(52) U.S. Cl. ..... 335/78; 335/83
(58) Field of Search ..... 335/78–85

(56) References Cited

U.S. PATENT DOCUMENTS 5,748,061 A 5/1998 Tsutsui et al. ..... 335/83

FOREIGN PATENT DOCUMENTS

JP 11016471 A * 1/1999 ..... H01H/50/54

* cited by examiner

*Primary Examiner*—Ramon M. Barrera
(74) *Attorney, Agent, or Firm*—Osha & May L.L.P.

(57) ABSTRACT

A small-sized electromagnetic relay which can afford high current and dissipate generated heat efficiently is disclosed. A plate section 18*c* for coupling to one side of a yoke 14 is formed on a movable contact terminal 18. Countersunk rivet features at three or more positions which are not aligned on a line on the plate section 18*c* couple the movable contact terminal 18 to the yoke 14. A base end 16*b* of a movable contact spring 16 is coupled to the surface of the plate section 18*c* opposite to the yoke 14 to support the movable contact spring 16. In the countersunk rivet feature, each protrusion 14*a* formed on the yoke 14 is inserted into the corresponding countersunk hole 18*d* formed on the plate section 18*c*, respectively, and the tops of the protrusions 14*a* are crushed to expand its diameter so as to sandwich the plate section 18*c* against the yoke 14.

2 Claims, 5 Drawing Sheets

ELECTROMAGNETIC RELAY

CROSS-REFERENCE TO RELATED APPLICATIONS

This patent application claims priority from Japanese Application No. 338994/2002, filed Nov. 22, 2002.

BACKGROUND OF INVENTION

1. Field of the Invention

The present invention relates to a small-sized electromagnetic relay to be mounted on a substrate.

2. Background Art

One of the known types of electromagnetic relays for mounting on a substrate comprises a coil constituting an electromagnet, an iron core, a yoke, a movable iron member (armature) attracted by the electromagnet, a movable contact spring to return the movable iron member to its initial position, a movable contact coupled to the movable iron member, a stationary contact disposed opposite to the movable contact, a stationary contact terminal conductively coupled to the stationary contact to lead to the outside, and a movable contact terminal conductively coupled to the movable contact to lead to the outside, as disclosed in JP-UM-A-3-86545. The movable contact opens/shuts relative to the stationary contact by means of the attractive force of the electromagnet and the resilient action of the movable contact spring, so as to change the conductive state between the movable contact terminal and the stationary contact terminal.

This type of conventional electromagnetic relay typically has a construction as follows for the movable contact terminal and its surrounding area.

In a first arrangement as shown in the FIG. 8 of JP-UM-A-3-86545 for example, a plate-shaped movable contact spring is attached to the backside of the yoke, one end of the spring being provided with to a movable contact, and the other end of the spring extending externally beyond a flange of a coil bobbin (a member on which the coil is wrapped, also known as a spool). This other end of the movable contact spring provides a leading end of the movable contact terminal inserted into a through-bore of a substrate. In a second arrangement as shown in the FIG. 1 of JP-UM-A-59-103346 for example, a part of the yoke extends externally beyond the flange to provide a leading end.

In a third arrangement as shown in the FIG. 2(B) of JP-A-63-252333, the movable contact spring is attached to the backside of the yoke, furthermore, another member (a movable contact leading terminal) is attached to the backside of the movable contact spring. One end of this member extends externally beyond the flange to provide a leading end.

In these types of electromagnetic relay, the component of the terminal (the movable contact spring in the above first example, or another member in the above third example) is attached to the yoke by countersunk rivet as shown in the FIGS. 5A and 5B. As shown in the FIG. 5A, a protrusion 2 is formed by pressing (forging) on the member 1 of the yoke or the like, then the protrusion 2 is inserted into a through-bore 4 formed in the terminal component 3. Next, as shown in the FIG. 5B, a conical-tool is urged on the center of the top surface of the protrusion 2 to provide plastic deformation for forming a groove having a V-shaped cross-section, then the protrusion 2 is spread in its diameter direction. The outer surface of the protrusion 2 is attached tightly to the inner surface of the through-bore 2 to fix the terminal component 3 to the member 1. This countersunk rivet feature is advantageous in that it is effective even when the height of the protrusion 2 is not sufficient relative to the thickness of the terminal component 3, and in that this feature is relatively easy to manufacture. However, it cannot urge the terminal component 3 on the member, 1, thus, the terminal component 3 cannot be tightly attached to the member 1.

The convention electromagnetic relay mentioned above suffers a number of disadvantages. First, the heat generated mainly in the coil or in the movable contact spring cannot be efficiently dissipated to the outside (the substrate side, for example) through the movable contact terminal, that is, the relay cannot dissipate the heat efficiently. Particularly, if a relay is designed for high current, the relay must have a large size as a whole to suppress the rise in its temperature. The large-sized relay needs a large substrate for mounting it, and the large substrate, in turn, needs a large housing for accommodation.

In the above-mentioned first arrangement, the movable contact spring serves as a movable contact terminal as well, which generates much heat that cannot be efficiently dissipated. The movable contact spring must be thin and made from a material suitable for a spring (material with low heat-conductivity such as copper alloy having low copper contents) in order to ensure flexibility.

Therefore when high current flows through the spring, it generates significant heat and the heat thus generated cannot readily escape to the outside.

In the above-mentioned second arrangement, the yoke serves as a movable contact terminal as well, which also dissipates hardly the generated heat. The yoke must be made from a material suitable for a magnetic body in order to attain a feature as an electromagnet (material such as pure iron having low heat-conductivity), so that the generated heat cannot readily escape to the outside.

In the above-mentioned third arrangement, the movable contact terminal consists of another member attached to the backside of the movable contact spring which, in turn, is attached to the yoke. Again, this arrangement cannot dissipate the generated heat efficiently. The heat from the yoke is transferred to another member via a member having low heat-conductivity (i.e. the movable contact spring), then be transferred through this another member to the outside. The heat must pass through the movable contact spring on the way to the outside, which prevents the heat from dissipating efficiently.

Also the conventional countersunk rivet feature as shown in the FIGS. 5A and 5B, has only limited contact area, that is, the areas which couple these two members are only the outer surface of the protrusion 2 and the inner surface of the through-bore 4 are closely attached. These two members attached via the countersunk rivet feature themselves do not attach tightly to each other. Thus, the members attached have low heat-conductivity, which also makes it difficult for the generated heat to be dissipated to the outside in the conventional electromagnetic relay therefore having limitation.

SUMMARY OF INVENTION

An electromagnetic relay of the invention comprising a coil constituting an electromagnet, an iron core, a yoke, a movable iron member (armature) attracted by an electromagnet, a movable contact spring to return the movable iron member to its initial position, a movable contact coupled to the movable iron member, a stationary contact disposed opposite to the movable contact, a stationary contact terminal conductively coupled to the stationary contact to lead to the outside, and a movable contact terminal conductively coupled to the movable contact to lead to outside, wherein the movable contact opens/shuts relative to the stationary contact by means of the attractive force of the electromagnet and the resilient action of the movable contact spring, so as to change the conductive state between the movable contact terminal and the stationary contact terminal, characterized in that;

a plate section which is coupled to at least one side of the yoke is formed in the movable contact terminal, the movable contact terminal being coupled to the yoke at one or more particular point(s) of the plate section by countersunk rivet feature(s);

the movable contact spring is coupled to the surface on the plate section opposite to the yoke; and the countersunk rivet feature is formed by inserting a protrusion formed on the yoke into a countersunk hole formed on the plate section, and crushing the top of the protrusion to increase the diameter so as to sandwich the plate section against the yoke.

According to the electromagnetic relay of the present invention, the movable contact terminal contacts tightly to the yoke with wider contact area with intensified strength than in the conventional electromagnetic relay, which provides significantly enhanced heat-conductivity between the yoke and the movable contact terminal. Furthermore, the hole of the movable contact terminal constituting the countersunk rivet feature has a countersunk form, so that the movable contact terminal can have sufficient thickness without compromising function of above-mentioned countersunk rivet feature even when the protrusion of the yoke cannot have sufficient height due to limit in the pressing. This arrangement can maintain high productivity while remarkably enlarging the cross-section of the movable contact terminal to the lead end. The movable contact terminal is a separate member from the movable contact spring and the yoke, so that it is possible to make it with a material having high heat-conductivity such as pure copper, which provides extremely high heat-conductivity from the movable contact terminal to the substrate or the like.

Also, according to the electromagnetic relay of the invention, the movable contact spring is directly coupled to the movable contact terminal. This arrangement provides high heat-conductivity between the movable contact spring and the movable contact terminal.

Thus, the heat generated at the coil is transferred to the yoke through the iron core, then, to the substrate or the like via the movable contact terminal for efficient dissipation. The coil and the yoke are free from accumulation of the heat. Also, the heat generated in the movable contact spring by the current flowing therethrough is transferred to the substrate or the like and radiated with grate efficiency via the movable contact terminal which is directly coupled thereto in a same manner without accumulated in the moveable contact spring.

Therefore, a small-sized, high productivity electromagnetic relay affording high-current with little rise in its temperature can be achieved by the invention.

Preferably, the positions where the movable contact terminal is coupled to the yoke via the countersunk rivet feature are three or more than three which are not aligned on a line on the plate section. This arrangement improves tightness in the contact between the movable contact terminal and the yoke.

DETAILED DESCRIPTION

Figure 1:
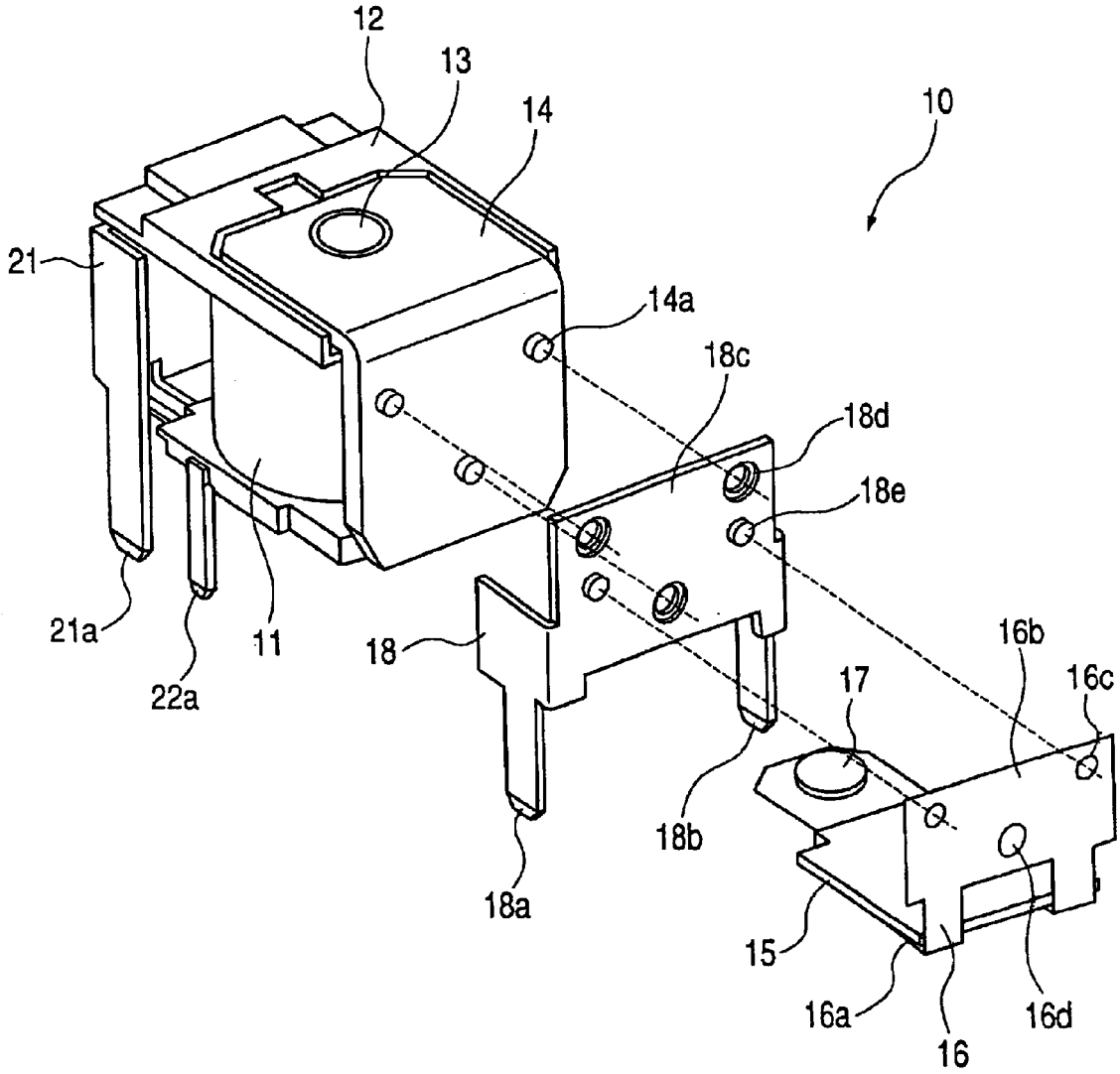
FIG. 1 is a perspective view of an electromagnetic relay (to which a movable contact terminal or the like is not yet attached), according to one embodiment of the present invention.
Figure 2:
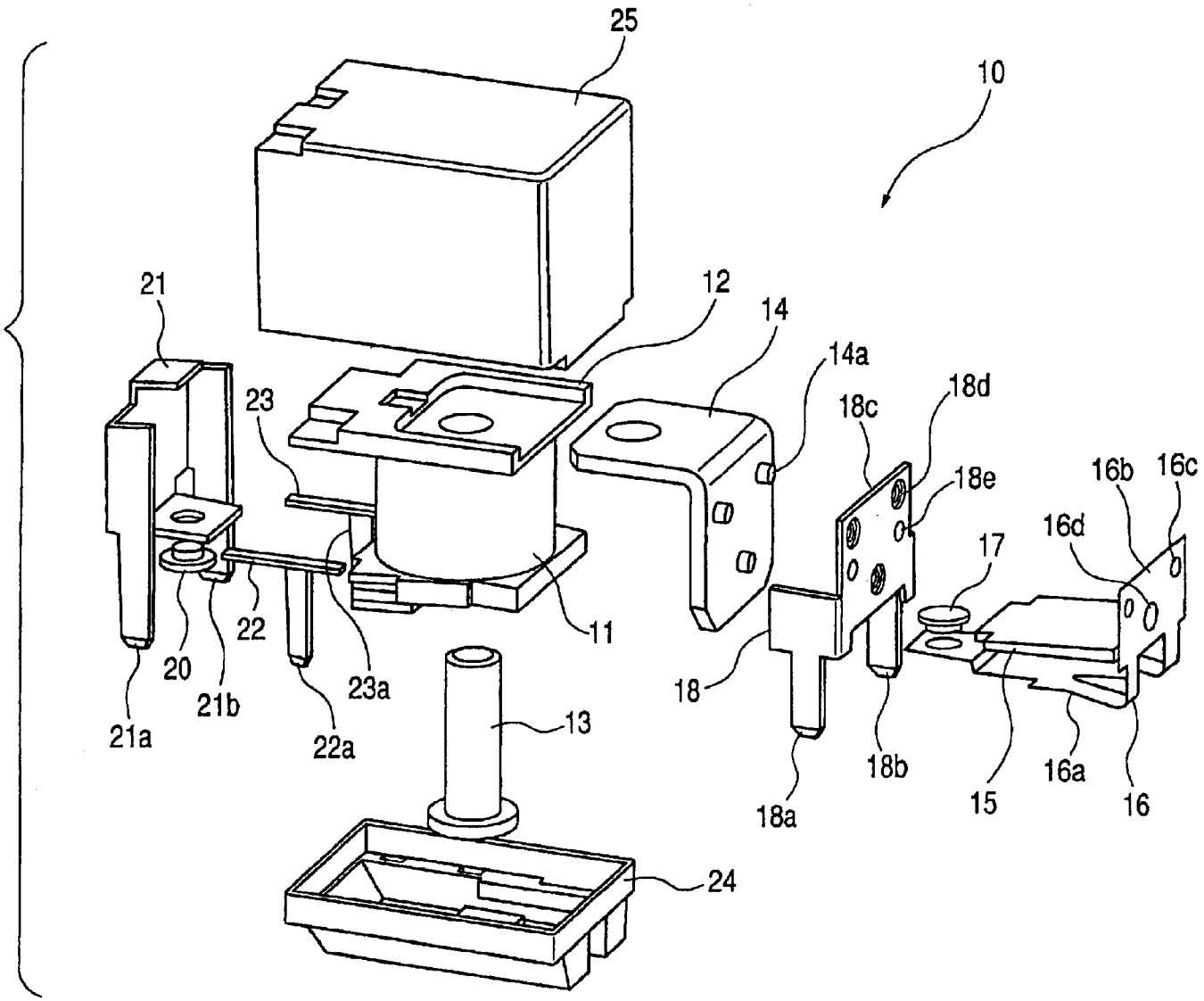
FIG. 2 is an exploded perspective view of the electromagnetic relay according to the embodiment of the invention.
Figure 3:
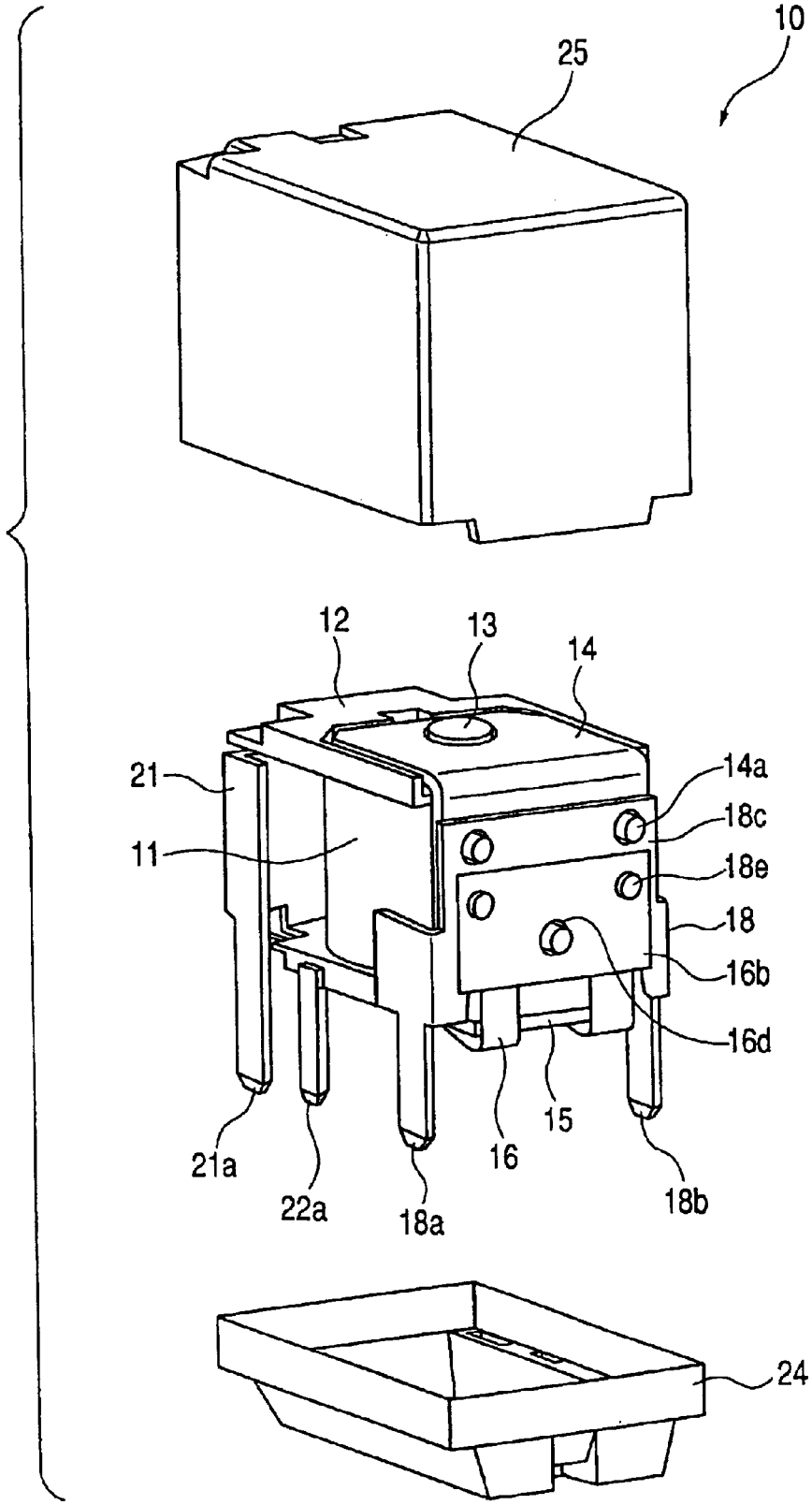
FIG. 3 is a perspective view of the electromagnetic relay (to which a case or the like is not yet attached), according to one embodiment of the invention.

Next, an exemplary embodiment of the invention is described with reference to the drawings. FIG. 1 shows a perspective view of an electromagnetic relay 10 of this embodiment (a movable contact terminal 18 or the like , which will be described below, is not yet attached), while FIG. 2 shows an exploded perspective view of the same. FIG. 3 shows a perspective view of the electromagnetic relay 10 (a case 25 or the like, which will be described below, is not yet attached), while FIGS. 4A to 4C each shows a countersunk rivet feature that attaches a movable contact terminal 18 to a yoke 14 which will be described below.

It should be noted that the case opening side, end side, or lower side refers to the side on which the case 25 opens (lower side in the FIG. 3), and the case backside, top side, or upper side refers to the opposite side.

As shown in FIG. 2, the electromagnetic relay 10 comprises a spool 12 on which a coil 11 constituting an electromagnet is wrapped, an iron core 13 of the electromagnet which is inserted for mounting in the spool 12, a L-shaped yoke 14 which is coupled to the upper end of the iron core 13 to provide a path for the magnetic force lines, a movable iron member 15 having a base end coupled to the lower end of the yoke 14 and a front end swinging by the attractive force of the iron core 13 when current flows through the coil, a movable contact spring 16 having a lower plate section 16*a* as a swingable plate spring to be attached to the lower side of the movable iron member 15, a movable contact 17 which is attached to the front end of the plate section 16*a* of the movable contact spring 16 by countersunk rivet features, a movable contact terminal (common terminal) 18 which is coupled to the yoke 14 and the movable contact spring 16 for conductively coupling to the movable contact 17 via the movable contact spring 16, a stationary contact 20 (NO contact) on which the movable contact 17 is urged when current flows through the coil, a stationary contact terminal 21 on which the stationary contact 20 is attached by countersunk rivet features, a first coil terminal 22 and a second coil terminal 23 which are connected to each leading wire from the coil 11 respectively, a base 24 which serves as a substrate to carry the above-mentioned elements on the upper side, and a case 25 having an opening lower end to cover the upper side of the base 24 to cover the above-mentioned elements.

This electromagnetic relay 1 is a so-called 1*a* type of electromagnetic relay which has single normal open contact (NO contact). The relay has the movable contact terminal 18, the stationery contact terminal 21, the first coil terminal 22 and the second coil terminal 23 as terminals to be lead to the outside and connected to a circuit conductor such as a circuit board. The leading ends 18*a*, 18*b*, 21*a*, 21*b*, 22*a*, and 23*a* for connection are formed on the lower side of the respective terminals and extend downwardly from the lower side of the base 24 to facilitate mounting on a circuit board or the like. The movable contact terminal 18 and the stationary contact terminal 21 have two leading ends 18*a*, 18*b* and 21*a*, 21*b*, respectively in order to reduce resistance.

Figure 4A:
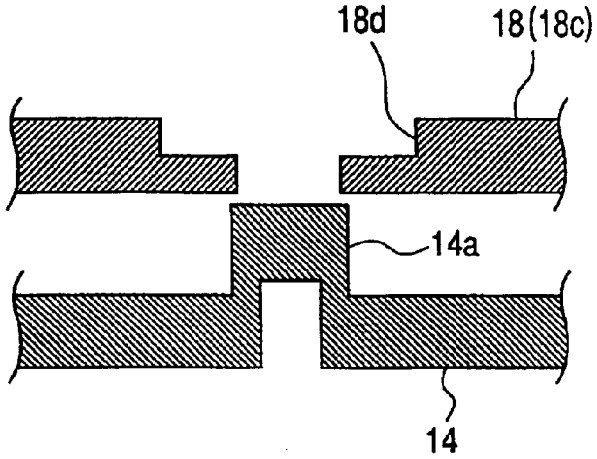
FIGS. 4A to 4C each shows a countersunk rivet feature with which a moving contact terminal is attached to the yoke.
Figure 4B:
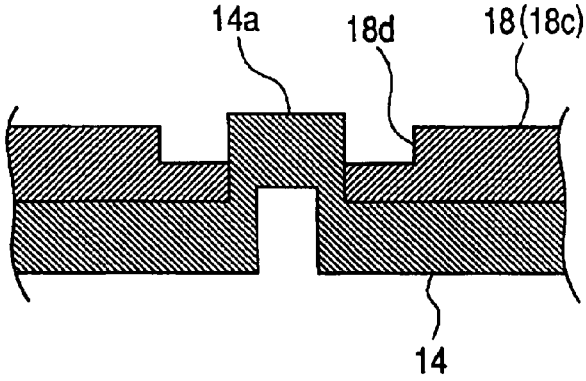
Figure 4C:
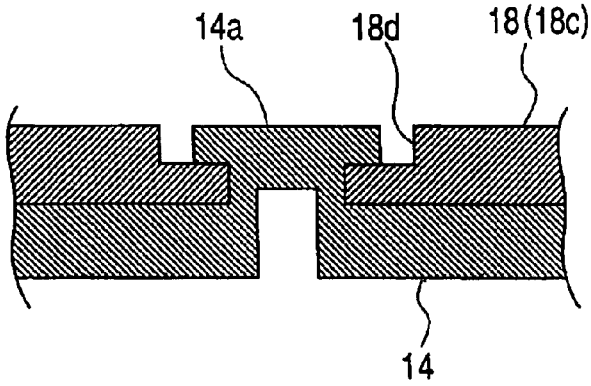
Figure 5A:
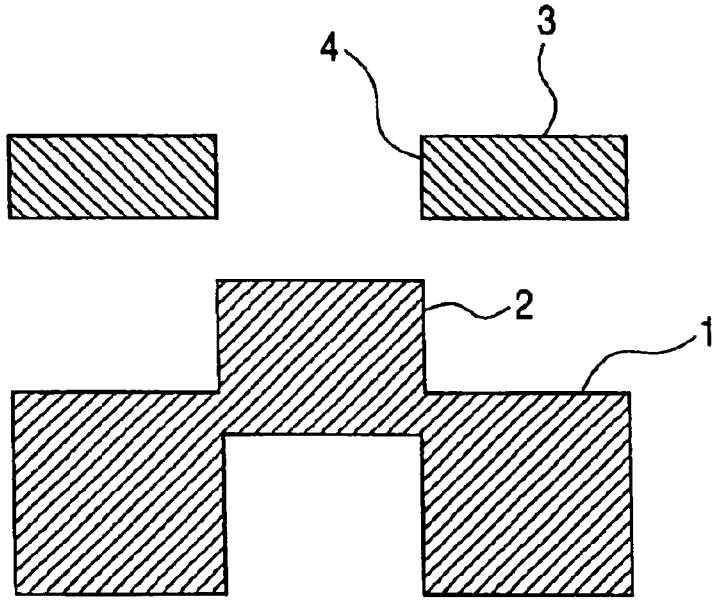
FIGS. 5A and 5B each shows a conventional countersunk rivet feature.
Figure 5B:
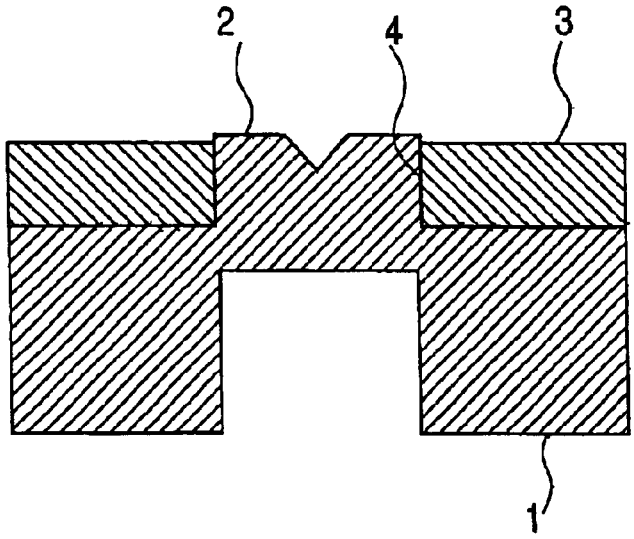

A plate section 18*c* which is coupled to the outer surface of the sidewall of the yoke 14 (a plate section facing the opening side of the case) is formed on the movable contact terminal 18. The movable contact terminal 18 is tightly fixed on the yoke 14 by the countersunk rivet features at three or more points not aligned on one line on the plate section 18*a*. In this case, as shown in FIG. 1, 14*a* is formed by pressing at three points (apexes of a triangle) on the outer surface of the side wall of the yoke 14. On the other hands, countersunk holes 18*d* are formed on the plate section 18*c* of the movable contact terminal 18 at three points corresponding to the points of the protrusions 14*a*, respectively. The countersunk rivet feature is formed as follows. As shown in FIGS. 4A and 4B, each protrusion 14*a* is inserted to each countersunk hole 18*d* respectively, then, as shown in FIG. 4A to 4C, the top of each protrusion 14*a* is crushed to spread the diameter in the axial direction in order to sandwich the plate section 18*c* against the yoke 14. The countersunk hole 18*d* is a through-bore, and its inner diameter on the outer side (the side opposite the yoke 14) is much larger than the protrusion 14*a* after being spread, while its inner diameter on the inner side (a side facing the yoke 14) is slightly larger (allowing space to fit) than the protrusion 14*a* before being spread. Thus, countersunk rivet feature is possible even when the height of the protrusion 14*a* is not sufficient relative to the thickness of the plate section of the movable contact terminal 18 (plate section 18*c*).

At least the movable contact terminal 18 among the terminals is made from a material having particularly high heat-conductivity (pure copper or copper alloy with high pure copper content, for example), and remarkably thicker than the movable contact spring 16. Also the moveable contact terminal 18 has, the leading ends 18*a* and 18*b*, and connection section from the plate section 18*c* to the leading ends 18*a* and 18*b* much wider than the conventional arrangement. On the contrary, the length of the connection section from the plate section 18*c* to the leading ends 18*a* and 18*b* (i.e., leading length) is shorter than the conventional arrangement. The plate section 18*c* is adapted to be large enough to cover substantially all the outer surface of the sidewall of the yoke 14.

Next, as shown in the FIG. 1, the base end 16*b* of the movable contact spring 16 is coupled to cover the outer surface of the plate section 18*c* of the movable contact terminal 18. The countersunk rivet feature at this coupling point fixes and supports the movable contact spring 16 to the movable contact terminal 18. That is as shown in FIG. 1, two protrusions 18*e* are formed by pressing on two positions on the plate section 18*c*. Two holes 16*c* through which these protrusions 18*e* can be inserted are formed on the movable contact spring 16 at the positions corresponding to these protrusions 18*e*. The protrusion 18*e* is inserted into the hole 16*c*, then crushed to spread its diameter. Thus, this countersunk rivet feature is similar to that shown in FIGS. 4A to 4C, wherein the base end 16*b* of the movable contact spring 16 is tightly fixed to the outer surface of the plate section 18*c* of the movable contact terminal 18. The base end 16*b* has a size substantially covering the outer surface of the plate section 18*c* of the movable contact terminal 18. Also, a hole designated by reference number 16*d* in FIG. 1 and the like is provided to prevent interference with the lower protrusion of the three protrusions 14*a* on the yoke 14.

As described, the electromagnetic relay according to this embodiment has the plate section 18*c* formed on the movable contact terminal 18 to couple to one side of the yoke 14, and countersunk rivet features on the three or more points which are not aligned on a line on the plate section 18*c* couple the movable contact terminal 18 to the yoke 14. Furthermore, the base end 16*b* of the movable contact spring 16 is coupled to the surface of the plate section 18*c* opposite to the yoke 14 to support the movable contact spring 16. The countersunk rivet feature as shown in the FIGS. 4A to 4C is formed as follows. Each protrusion 14*a* formed on the yoke 14 is inserted in to each countersunk hole 18*d* formed on the plate section 18*c* respectively, then the tops of the protrusions 14*a* are crushed and increased in diameter so as to sandwich the plate section 18*c* against the yoke 14.

This arrangement provides significantly tighter contact between the movable contact terminal 18 and the yoke 14 with wider contact area than the conventional arrangement, so that the arrangement according to the invention provides significantly high heat-conductivity between the yoke 14 and the movable contact terminal 18. In addition, since the holes 18*d* of the movable contact terminal 18 have a countersunk form for rivet function, even when the protrusions 14*a* of the yoke 14 have low height within the limit in pressing, a movable contact terminal 18 with sufficient thickness can be obtained while achieves the above-mentioned countersunk rivet feature. This allows to ensure much larger cross-section of the movable contact terminal 18 to the leading ends 18*a* and 18*b* than the conventional arrangement while maintaining high productivity. Furthermore, since the movable contact terminal 18 is a separate member from the movable contact spring 16 and the yoke 14, the terminal 18 can be made from a material having high heat-conductivity such as pure copper. This gives high heat-conductivity from the movable contact terminal 18 to the substrate or the like. It should be noted the movable contact spring has to be made from certain copper alloy such as beryllium copper for ensuring flexibility. Such copper alloy has lower heat-conductivity, i.e., about two-third of that of pure copper. Also, the pure iron, a material of the yoke, has further lower heat-conductivity than the copper alloy. Thus, the conventional arrangement which uses the movable contact spring or the yoke as a movable contact terminal cannot improve the heat-conductivity from the movable contact terminal to the substrate or the like.

Also in the electromagnetic relay according to the embodiment, the movable contact spring 16 is directly coupled to the movable contact terminal 18.

Thus the high heat-conductivity between the movable contact spring 16 and the movable contact terminal 18 is ensured.

The heat generated at the coil 11 is transferred to the yoke 14 via the iron core 13, then to the substrate or the like via the movable contact terminal 18 for dissipation with great efficiency. The heat will not accumulate in the coil 11 or in the yoke 14. Also, the heat generated at the movable contact spring due to the current flowing through the movable contact spring 16 does not accumulate therein. Instead, the heat is transferred to the substrate or the like for efficient dissipation via the movable contact terminal 18 which is directly coupled thereto.

Therefore, a small-sized electromagnetic relay affording high current with little rise in its temperature can be obtained with high productivity according to the teaching of the invention.

It should be noted that the invention is not limited to the above-described embodiment.

For example, the plate section 18*c* of the movable contact terminal 18 of the above embodiment can be formed in an L-shape along the yoke 14 so as to contact to the upper side of the upper wall of the yoke 14, as well (plate section at the backside of the case of the yoke 14). This arrangement can further enlarge the contact area between the yoke 14 and the movable contact terminal 18. Alternatively, the base end 16*b* of the movable contact spring 16 (a connection to the movable contact terminal 18) can have an area large enough to cover all the plate section 18*c* of the movable contact terminal 18 so as to further improve the heat-conductivity.

Also, the invention is applicable to the electromagnetic relay wherein a base is eliminated and a flange on the case opening side of the spool serves as a base.

In the above embodiment, the invention is applied to a so-called a-contact type electromagnetic relay which has a-contact only. However, as is apparent to the person skilled in the art, the invention is applicable to a c-contact type (a type having both a-contact and b-contact), b-contact type having b-contact only, and a type having a plurality of the same type of contacts, as well.

The invention provides a small-sized, high productivity electromagnetic relay affording high current with little rise in its temperature.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electromagnetic relay comprising a coil constituting an electromagnet, an iron core, a yoke, a, movable iron member attracted by an electromagnet, a movable contact spring to return said movable iron member to its initial position, a movable contact coupled to said movable iron member, a stationary contact disposed opposite to said movable contact, a stationary contact terminal conductively coupled to said stationary contact to lead to the outside, and a movable contact terminal conductively coupled to said movable contact to lead to outside, wherein said movable contact opens/shuts relative to said stationary contact by means of the attractive force of the electromagnet and the resilient action of said movable contact spring, so as to change the conductive state between said movable contact terminal and said stationary contact terminal, characterized in that:

a plate section which is coupled to at least one side of said yoke is formed in said movable contact terminal, said movable contact terminal being coupled to said yoke at one or more particular point(s) of said plate section by countersunk rivet feature(s);

said movable contact spring is coupled to the surface on said plate section opposite to said yoke; and said countersunk rivet feature is formed by inserting a protrusion formed on said yoke into a countersunk hole formed on said plate section, and crushing the top of said protrusion increase its diameter so as to sandwich said plate section against said yoke.

2. The electromagnetic relay according to claim 1, wherein said particular points are three or more points which are not in a straight line on said plate section.

* * * * *

UNITED STATES PATENT AND TRADEMARK OFFICE

CERTIFICATE OF CORRECTION

PATENT NO. : 6,784,773 B2
DATED : August 31, 2004
INVENTOR(S) : Kazuhiro Tsutsui et al.

It is certified that error appears in the above-identified patent and that said Letters Patent is hereby corrected as shown below:

Column 7,
Line 32, please remove the "comma" after the word "a" and before the word "movable".

Signed and Sealed this

Fourteenth Day of December, 2004

JON W. DUDAS
*Director of the United States Patent and Trademark Office*